US010760154B2

(12) United States Patent
Furukawa et al.

(10) Patent No.: US 10,760,154 B2
(45) Date of Patent: Sep. 1, 2020

(54) HOT-DIP AL-PLATED STEEL SHEET AND METHOD FOR PRODUCING SAME

(71) Applicant: Nisshin Steel Co., Ltd., Tokyo (JP)

(72) Inventors: Shinya Furukawa, Tokyo (JP); Koutarou Ishii, Tokyo (JP); Yasunori Hattori, Tokyo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 16/083,743

(22) PCT Filed: Aug. 18, 2016

(86) PCT No.: PCT/JP2016/074058
§ 371 (c)(1),
(2) Date: Sep. 10, 2018

(87) PCT Pub. No.: WO2017/154237
PCT Pub. Date: Sep. 14, 2017

(65) Prior Publication Data

US 2019/0078189 A1 Mar. 14, 2019

(30) Foreign Application Priority Data

Mar. 11, 2016 (JP) ..... 2016-048879

(51) Int. Cl.
*C23C 2/12* (2006.01)
*C23C 2/40* (2006.01)
*C22C 21/00* (2006.01)

(52) U.S. Cl.
CPC ..... *C23C 2/12* (2013.01); *C23C 2/40* (2013.01); *C22C 21/00* (2013.01)

(58) Field of Classification Search
CPC .... C23C 2/12; C23C 4/06; C23C 6/00; C23C 10/48; C23C 10/56; C23C 18/10
See application file for complete search history.

(56) References Cited

U.S. PATENT DOCUMENTS 2,774,686 A * 12/1956 Hodge ..... C23C 2/12 427/431
6,440,582 B1 8/2002 McDevitt et al.
(Continued)

FOREIGN PATENT DOCUMENTS

CA 2947403 A1 12/2015
CH 271946 A 11/1950
(Continued)

OTHER PUBLICATIONS

Office Action for Chinese Patent Application No. 2016800833722, dated Apr. 26, 2019, English translation, 11 pages.
(Continued)

*Primary Examiner* — Vanessa T. Luk
(74) *Attorney, Agent, or Firm* — Mintz Levin Cohn Ferris Glovsky and Popeo, P.C.; David G. Conlin; Joohee Lee

(57) ABSTRACT

Provided is (i) a hot-dip Al-based alloy-coated steel sheet which includes a coated layer having a surface on which fine spangles are stably and sufficiently formed and which has a beautiful surface appearance due to the fine spangles thus formed on the surface of the coated layer, and (ii) a method of producing such a hot-dip Al-based alloy-coated steel sheet. The hot-dip Al-based alloy-coated steel sheet includes: a substrate steel sheet; and a hot-dip aluminum-based alloy coated layer which is formed on a surface of the substrate steel sheet and which contains boron at an average concentration of not less than 0.005 mass % and contains potassium at an average concentration of not less than 0.0004 mass %.

6 Claims, 1 Drawing Sheet

(56) References Cited

U.S. PATENT DOCUMENTS

| | | | | |
|---|---|---|---|---|
| 2002/0058154 | A1 | 5/2002 | Friedersdorf et al. | |
| 2003/0113575 | A1 | 6/2003 | McDevitt | |
| 2004/0161629 | A1 | 8/2004 | McDevitt | |
| 2005/0181229 | A1 | 8/2005 | McDevitt et al. | |
| 2007/0068682 | A1 | 3/2007 | McKinlay | |
| 2007/0181314 | A1 | 8/2007 | McKinlay | |
| 2016/0060735 | A1 | 3/2016 | Maki et al. | |
| 2016/0186284 | A1 * | 6/2016 | Furukawa | C22C 38/02 428/653 |
| 2017/0114436 | A1 | 4/2017 | Furukawa et al. | |
| 2017/0198152 | A1 * | 7/2017 | Blumenau | C09D 1/00 |

FOREIGN PATENT DOCUMENTS

| | | | | |
|---|---|---|---|---|
| CN | 103147029 | A | | 6/2013 |
| DE | 1138603 | B | | 10/1962 |
| JP | 62-023976 | | | 1/1987 |
| JP | 05-179384 | | | 7/1993 |
| JP | 11-350095 | | | 12/1999 |
| JP | 2002332555 | A | * | 11/2002 |
| JP | 2004-115908 | A | | 4/2004 |
| JP | 2006-070326 | A | | 3/2006 |
| JP | 5591414 | B1 | | 9/2014 |
| KR | 2015-0127725 | A | | 11/2015 |
| WO | 01/27343 | A1 | | 4/2001 |
| WO | WO-2014171417 | A1 | * | 10/2014 |
| WO | WO-2015022821 | A1 | * | 2/2015 |

OTHER PUBLICATIONS

Office Action dated Nov. 16, 2018 in Korean Patent Application No. 10-2018-7028830.

Decision to Grant a Patent dated Oct. 25, 2016 in corresponding Japanese Patent Application No. JP 2016-048879 (English language translation supplied).

Notification of Reasons for Refusal dated Sep. 6, 2016 in corresponding Japanese Patent Application No. 2016-048879 (English language translation supplied).

International Preliminary Report on Patentability dated Sep. 11, 2018 is corresponding International Application No. PCT/JP2016/074058.

Extended European Search Report for European Patent Application No. 16893561.7, dated Jun. 4, 2019, 5 pages.

International Search Report dated Sep. 20, 2016 in PCT/JP2016/074058.

Office Action dated Jan. 17, 2020 for U.S. Appl. No. 16/083,743, 7 pages.

* cited by examiner

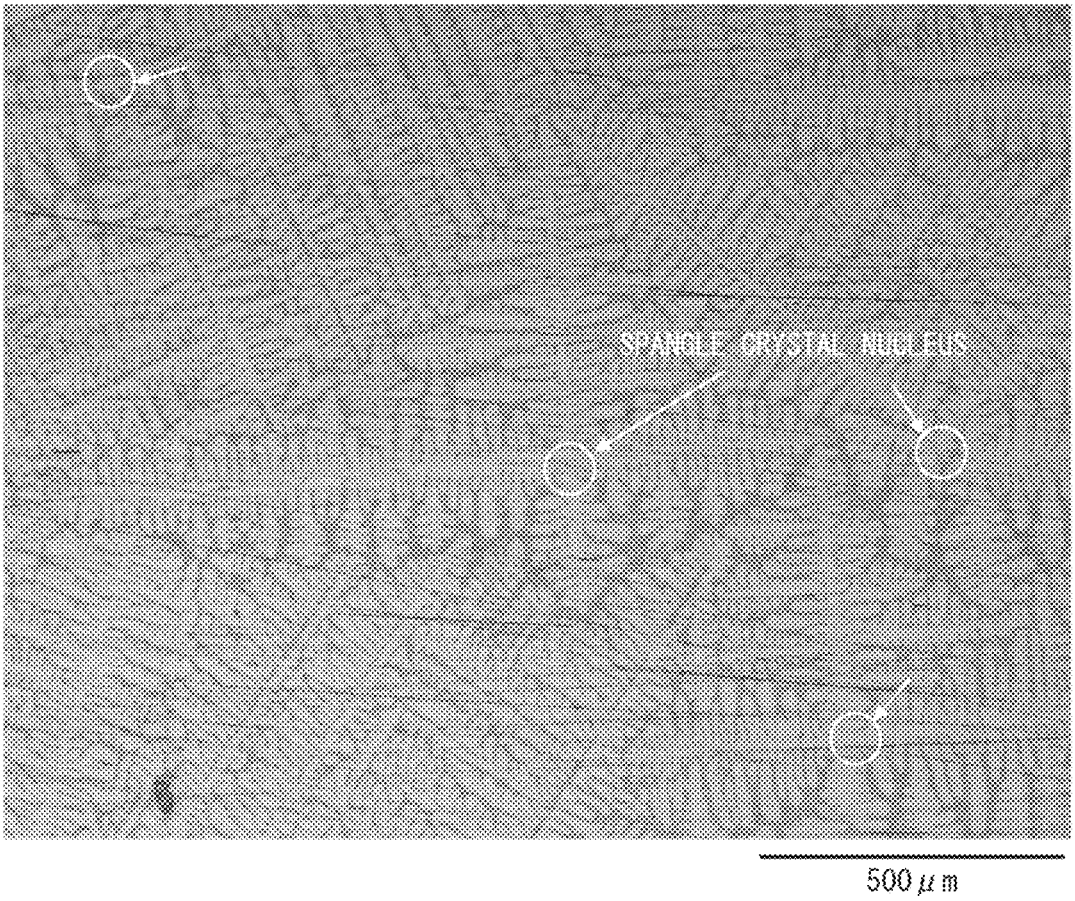
SPANGLE CRYSTAL NUCLEUS
500 μm

HOT-DIP AL-PLATED STEEL SHEET AND METHOD FOR PRODUCING SAME

RELATED APPLICATIONS

This application is the U.S. national stage pursuant to 35 U.S.C. § 371, of International application Ser. No. PCT/JP2016/074058, filed Aug. 18, 2016 and published on Sep. 14, 2017 as publication WO 2017/154237 A1, which claims the benefit of priority of Japanese Application No. 2016-048879, filed Mar. 11, 2016, which are hereby expressly incorporated by reference in their entirety.

TECHNICAL FIELD

The present invention relates to a hot-dip Al-based alloy-coated steel sheet and a method of producing the hot-dip Al-based alloy-coated steel sheet. More specifically, the present invention relates to (i) a hot-dip Al-based alloy-coated steel sheet which has spangles having a minute size and has a beautiful surface appearance due to such spangles, and (ii) a method of producing such a hot-dip Al-based alloy-coated steel sheet.

BACKGROUND ART

A hot-dip aluminum-based alloy-coated steel sheet (hereinafter referred to as a "hot-dip Al-based alloy-coated steel sheet") includes a steel sheet whose surface is coated with an alloy, which contains aluminum (Al) as a main component, by a hot-dip method so that the steel sheet can have higher corrosion resistance and/or higher heat resistance. Such a hot-dip Al-based alloy-coated steel sheet has been widely used mainly for members that are required to have heat resistance, such as exhaust gas members of automobiles and members of combustion devices.

Note that the hot-dip Al-based alloy-coated steel sheet has a coated layer having a surface on which a spangle pattern appears, the spangle pattern being formed due to dendrites, which are structures obtained by solidification of Al. The spangle pattern is a characteristic geometric pattern or a flower pattern, and each region (i.e., spangle) of the spangle pattern is constituted by dendrites.

A spangle grows during solidification of Al after coating. Growth of the spangle progresses as below. First, the nucleus of the spangle (i.e., spangle nucleus) occurs. Then, a primary dendrite arm grows from the spangle nucleus. Subsequently, a secondary dendrite arm develops from the primary dendrite arm. Growth of such dendrite arms stops due to a collision between adjacent spangles. It follows that presence of more spangle nuclei in the coated layer causes an increase in number of spangles. This causes each spangle to have a minute size.

The presence of such a spangle does not adversely affect a quality (e.g., corrosion resistance) of the hot-dip Al-based alloy-coated steel sheet. Note, however, that in the market, a hot-dip Al-based alloy-coated steel sheet is preferred which has spangles having a minute size and thus has a surface skin having an inconspicuous spangle pattern.

Under the circumstances, proposed is, for example, a method of producing a hot-dip aluminum-zinc alloy-coated steel sheet which includes a coated layer made of an aluminum-zinc alloy. According to this method, for the purpose of formation of fine spangles, titanium (Ti), zirconium (Zr), niobium (Nb), boron (B), a boride such as aluminum boride ($AlB_2$ or $AlB_{12}$), titanium carbide (TiC), titanium boride ($TiB_2$), or titanium aluminide ($TiAl_3$) is added to a coating bath so that more substances each acting as a spangle nucleus are obtained. Such a method is disclosed in, for example, Patent Literatures 1 to 3.

CITATION LIST

Patent Literatures

[Patent Literature 1]
Japanese Patent Application Publication Tokukai No. 2004-115908 (Publication date: Apr. 15, 2004)
[Patent Literature 2]
Japanese Patent Application Publication Tokukai No. 2006-22409 (Publication date: Jan. 26, 2006)
[Patent Literature 3]
Japanese Patent No. 3751879 (Publication date: Dec. 16, 2005)
[Patent Literature 4]
Japanese Patent No. 5591414 (Publication date: Sep. 17, 2014)

SUMMARY OF INVENTION

Technical Problem

Note, however, that use of the above method to produce a hot-dip Al-based alloy-coated steel sheet has the following problems.

Specifically, since aluminum (having a specific gravity of 2.7) is one of the lightweight metals, molten aluminum is lower in specific gravity than an aluminum-zinc alloy (having a specific gravity of 7.1). Thus, any of substances, such as Ti, titanium carbide (TiC), titanium boride ($TiB_2$), and titanium aluminide ($TiAl_3$), which are higher in specific gravity than a hot-dip Al-based alloy-coating bath, easily precipitates into a bath bottom, so that it is difficult for such a substance to be uniformly dispersed in the hot-dip Al-based alloy-coating bath. This causes a problem of difficulty in stable formation of fine spangles on surfaces of hot-dip Al-based alloy-coated steel sheets which are continuously produced as in an industrial continuous operation.

Meanwhile, B and aluminum boride ($AlB_2$ or $AlB_{12}$) are less different in specific gravity from an aluminum bath and thus are less likely to precipitate into a bath bottom. Note, however, that, as compared with, for example, $TiB_2$, B and aluminum boride ($AlB_2$ or $AlB_{12}$) are unfortunately bring about a less satisfactory effect of finer spangles.

For example, Patent Literature 4 discloses, as a B-containing hot-dip Al-based alloy-coated steel sheet, a hot-dip Al-based alloy-coated steel sheet which contains B at a concentration of 0.002 mass % to 0.080 mass %. Note, however, that according to the technique disclosed in Patent Literature 4, B which is unevenly distributed over a surface of a coated layer of a hot-dip Al-based alloy-coated steel sheet allows the coated layer to be more slidable against a mold, and consequently allows the coated layer to be more resistant to galling. It follows that Patent Literature 4 fails to disclose that fine spangles are formed so that a hot-dip Al-based alloy coated layer has a beautiful surface appearance.

The present invention has been made in view of the problems, and an object of the present invention is to provide (i) a hot-dip Al-based alloy-coated steel sheet which includes a coated layer having a surface on which fine spangles are stably and sufficiently formed and which has a beautiful surface appearance due to the fine spangles thus formed on the surface of the coated layer, and (ii) a method of producing such a hot-dip Al-based alloy-coated steel sheet.

Solution to Problem

The inventors of the present invention carried out a diligent study and finally accomplished the present invention by finding that, as compared with a hot-dip Al-based alloy-coated steel sheet obtained with use of a coating bath to which B or aluminum boride ($AlB_2$ or $AlB_{12}$) is added alone or titanium boride ($TiB_2$) and titanium aluminide ($TiAl_3$) are added, a hot-dip Al-based alloy-coated steel sheet obtained with use of a hot-dip Al-based alloy-coating bath containing both boron (B) and potassium (K) in proper amounts exhibits a more remarkable effect of finer spangles.

That is, a hot-dip aluminum-based alloy-coated steel sheet in accordance with an embodiment of the present invention includes: a substrate steel sheet; and a hot-dip aluminum-based alloy coated layer which is formed on a surface of the substrate steel sheet and which contains boron at an average concentration of not less than 0.005 mass % and contains potassium at an average concentration of not less than 0.0004 mass %.

Advantageous Effects of Invention

The present invention brings about an effect of providing (i) a hot-dip Al-based alloy-coated steel sheet which includes a coated layer having a surface on which fine spangles are stably and sufficiently formed and which has a beautiful surface appearance due to the fine spangles thus formed on the surface of the coated layer, and (ii) a method of producing such a hot-dip Al-based alloy-coated steel sheet.

BRIEF DESCRIPTION OF DRAWINGS

FIG. 1 is an optical photomicrograph of a state in which the outermost surface of a hot-dip Al-based alloy-coated steel sheet in accordance with an embodiment of the present invention has been polished so that a dendrite structure is made observable.

DESCRIPTION OF EMBODIMENTS

The following description will discuss an embodiment of the present invention. Note that, unless otherwise specified, the present invention is not limited to the following description, which is provided so that subject matters of the present invention are better understood. Note also that a numerical expression such as "A to B" as used herein means "not less than A and not more than B".

First, the following description will schematically discuss knowledge of the present invention before discussing a hot-dip Al-based alloy-coated steel sheet in accordance with an embodiment of the present invention and a method of producing such a hot-dip Al-based alloy-coated steel sheet.

(Schematic Description of Knowledge of Present Invention)

As described earlier, a spangle pattern formed due to dendrites commonly appears on a surface of a hot-dip Al-based alloy coated layer. In order that such a spangle pattern is made inconspicuous, various approaches have been taken. The spangle pattern can be made inconspicuous by, for example, a method of carrying out a surface treatment as a post treatment, e.g., carrying out skin-pass rolling many times after coating. However, such a method needs to be carried out with use of a major apparatus or by a special process. This results in an increase in production cost.

In view of the above problem, a method has been proposed in which the spangle pattern is made inconspicuous by causing each spangle to have a minute size. In order to cause spangles to have a minute size, it is only necessary to cause spangle nuclei which are formed at an early stage of growth of the spangles to be highly dense. That is, the spangles can have a minute size by heterogeneous nucleation of spangle nuclei.

For example, known is a technique in which a substrate steel sheet is dipped in and taken out of a coating bath, and then fine mist or fine metal oxide powder is sprayed over a surface of an unsolidified coated layer. Note, however, that such a technique may (i) prevent, due to flapping of a steel sheet in a continuous hot-dip aluminum-coating line, spangles from being stably made finer and/or (ii) necessitate an apparatus for carrying out a spraying process and an apparatus for monitoring the spraying process.

In view of the above problems, as described earlier, a technique has been proposed in which a substance acting as a spangle nucleus is added to a coating bath. According to this technique, fine spangles are obtained by dipping a substrate steel sheet in a coating bath whose components have been adjusted. Thus, this technique is low in cost and highly convenient. Note, however, that use of such a technique to produce a hot-dip aluminum-coated steel sheet causes such problems as described earlier.

Under the circumstances, the inventors of the present invention carried out detailed research on how various components that can be added to a coating bath influence fine spangles of a hot-dip Al-based alloy-coated steel sheet. As a result, the inventors found that a coating bath containing both B and K brings about a remarkable effect of finer spangles. That is, as compared with a hot-dip Al-based alloy-coated steel sheet obtained with use of a coating bath containing B or K alone, a hot-dip Al-based alloy-coated steel sheet obtained with use of a coating bath containing both B and K allows spangle nuclei formed on a surface of a coated layer to be denser. In particular, the research revealed that, as compared with a hot-dip Al-based alloy-coated steel sheet obtained with use of a coating bath to which B or aluminum boride ($AlB_2$ or $AlB_{12}$) is added alone or titanium boride ($TiB_2$) and titanium aluminide ($TiAl_3$) are added, a hot-dip Al-based alloy-coated steel sheet obtained with use of a hot-dip Al-based alloy-coating bath containing B at a concentration of not less than 0.005 mass % and K at a concentration of not less than 0.0004 mass % exhibits a more remarkable effect of finer spangles.

A specific mechanism by which a coating bath containing both B and K enhances an effect of finer spangles is still unclear. However, it is clear that, as compared with a coating bath to which B or aluminum boride is added alone, a coating bath containing both B and K even in very small amounts brings about a more remarkable effect of finer spangles. It has been known that B is enriched (unevenly distributed) over a surface of a coated layer. However, a coating bath containing B alone is insufficient to bring about a satisfactory effect of finer spangles. In view of this, examples of the mechanism by which a coating bath containing both B and K enhances the effect of finer spangles include a mechanism in which B and K form clusters and the clusters are unevenly distributed over a surface of a coated layer so as to each serve as a spangle nucleus.

Meanwhile, in a case where a coating bath contains both B and K but an amount in which the coating bath contains K is not excessive, (i) an effect, brought about by a hot-dip Al-based alloy coated layer, of improving corrosion resistance (red rust resistance) of a steel sheet and (ii) intrinsic workability of an Al-coated layer are maintained as in the case of a coating bath not containing both B and K.

The above knowledge of the present invention is novel in the field of hot-dip Al-based alloy-coated steel sheets, and the knowledge is great in terms of the following points. According to an embodiment of the present invention, by adjusting a composition of a hot-dip Al-coating bath, it is possible to easily and stably produce a hot-dip Al-based alloy-coated steel sheet which has spangles whose size has been made sufficiently minute and which has a beautiful surface skin due to such spangles. Furthermore, B and K, which are neither rare metals nor heavy metals, are abundant in the natural world and are harmless to human bodies. Moreover, B and K are less likely to precipitate into the bottom of a hot-dip Al-based alloy-coating bath. This makes it possible to stably produce hot-dip Al-based alloy-coated steel sheets by an industrial continuous operation. Thus, in another aspect, an embodiment of the present invention makes it possible to provide (i) a hot-dip Al-based alloy-coated steel sheet which can be produced at low cost, which is highly suitable for industrial and practical use, and which has spangles having a minute size and has a beautiful surface appearance due to such spangles, and (ii) a method of producing such a hot-dip Al-based alloy-coated steel sheet.

The foregoing description has schematically discussed the knowledge of the present invention. Next, a hot-dip Al-based alloy-coated steel sheet in accordance with an embodiment of the present invention will be discussed below.

(Hot-Dip Al-Based Alloy-Coated Steel Sheet)

The hot-dip Al-based alloy-coated steel sheet in accordance with an embodiment of the present invention will be discussed below with reference to FIG. 1. FIG. 1 is an optical photomicrograph of a state in which the outermost surface of the hot-dip Al-based alloy-coated steel sheet in accordance with an embodiment of the present invention has been polished so that a dendrite structure is made observable.

Schematically, the hot-dip Al-based alloy-coated steel sheet is produced by dipping a substrate steel sheet in a hot-dip Al-based alloy-coating bath, which contains aluminum as a main component, so as to form a hot-dip Al-based alloy coated layer on a surface of the substrate steel sheet. During the production, Al and iron (Fe) interdiffuse, so that an Al—Fe alloy coated layer is also formed between (on a boundary between) (i) a steel base material of the substrate steel sheet and (ii) the hot-dip Al-based alloy coated layer. On a surface of the hot-dip Al-based alloy coated layer, dendrites having grown from spangle crystal nuclei are present (see FIG. 1). The density of the spangle crystal nuclei present on the surface of the hot-dip Al-based alloy coated layer will be discussed later.

[Substrate Steel Sheet]

The substrate steel sheet can be selected from commonly-used substrate steel sheets in accordance with a purpose for which the substrate steel sheet is used. In a case where the substrate steel sheet is used while corrosion resistance is considered important, a stainless steel sheet is applicable. The substrate steel sheet can have a thickness of, for example, 0.4 mm to 2.0 mm. The substrate steel sheet as used herein encompasses a substrate steel strip.

[Al—Fe Alloy Layer]

The Al—Fe alloy layer is made mainly of an Al—Fe-based intermetallic compound. Note here that the hot-dip Al-based alloy-coating bath preferably contains silicon (Si). An Al—Fe-based alloy layer formed with use of an Si-containing Al-based alloy-coating bath contains a large amount of Si. Both an Si-free Al—Fe-based alloy layer and a so-called Al—Fe—Si-based alloy layer containing Si are herein collectively referred to as an Al—Fe-based alloy layer.

In a case where the Al—Fe-based alloy layer, which is made of a brittle intermetallic compound, has a greater thickness, the coated layer is made less adhesive. This leads to inhibition of press workability. From the viewpoint of press workability, the Al—Fe-based alloy layer preferably has a thickness that is as small as possible. However, a technique of a too large reduction in thickness of the Al—Fe-based alloy layer increases the process load, and such a technique is uneconomical. Generally, the Al—Fe-based alloy layer only needs to have an average thickness of not less than 0.5 μm.

[Composition of Hot-Dip Al-Based Alloy Coated Layer]

The hot-dip Al-based alloy coated layer has a chemical composition that is substantially identical to the composition of the coating bath. The composition of the coated layer can thus be controlled by adjusting the composition of the coating bath.

Note that the hot-dip Al-based alloy coated layer, which refers to a coated layer formed on the surface of the substrate steel sheet, encompasses the Al—Fe-based alloy layer. An aluminum oxide layer formed on the topmost surface of the hot-dip Al-based alloy-coated steel sheet causes no particular problem because the aluminum oxide layer is very thin. The aluminum oxide layer is therefore assumed to be encompassed in the hot-dip Al-based alloy coated layer. In a case where, for example, a film layer such as an organic film is further formed on the surface of the hot-dip Al-based alloy-coated steel sheet by a post treatment, such a film layer is, as a matter of course, not encompassed in the hot-dip Al-based alloy coated layer.

As such, the "average concentration" of a substance contained in the hot-dip Al-based alloy coated layer as used herein refers to an average of concentrations of the substance which concentrations are measured, in a direction in which the depth of the hot-dip Al-based alloy coated layer extends, from the surface of the substrate steel sheet of the hot-dip Al-based alloy-coated steel sheet to the outer surface of the hot-dip Al-based alloy coated layer of the hot-dip Al-based alloy-coated steel sheet. Specifically, as described later, the average concentration of a substance is measured by carrying out concentration analysis with respect to a measurement solution in which all the hot-dip Al-based alloy coated layer has been melted. That is, the average concentration of B, which is an element enriched on the surface of the hot-dip Al-based alloy coated layer, refers to the concentration of B contained in the hot-dip Al-based alloy coated layer, the concentration being obtained by averaging concentrations of B assuming that no B is enriched on the surface of the hot-dip Al-based alloy coated layer. Furthermore, the concentration of B contained in the hot-dip Al-based alloy-coating bath is reflected in the average concentration of B contained in the hot-dip Al-based alloy coated layer formed through coating.

The hot-dip Al-based alloy coated layer at least contains B and K while containing Al as a main component. Note, however, that the hot-dip Al-based alloy coated layer can contain other element(s).

Si is an additive element that is necessary for inhibition of growth of the Al—Fe alloy layer during hot-dip coating. The Al-based alloy-coating bath to which Si is added has a lower melting point. This is effective in reducing a temperature at which coating is carried out. In a case where the coating bath contains Si at a concentration of less than 1.0 mass %, the Al—Fe-based alloy layer is formed thick during hot-dip coating due to interdiffusion of Al and Fe. This causes peeling off in the coated layer during processing such as press forming. Meanwhile, in a case where the coating bath contains Si at a concentration of more than 12.0 mass %, the coated layer is cured. This makes it impossible to prevent cracking in a bent part of the coated layer and consequently causes the bent part to have lower corrosion resistance. Therefore, the coating bath preferably contains Si at a concentration of 1.0 mass % to 12.0 mass %. In particular, the coating bath which contains Si at a concentration of less than 3.0 mass % (i) allows an Si phase to be formed in a smaller amount during solidification of the coated layer and (ii) allows softening of a primary crystal Al phase. Such a coating bath is thus more effective in applications in which bending workability is considered important.

In the hot-dip Al-based alloy-coating bath, Fe is mixed which comes from the substrate steel sheet and/or a constituent member(s) of a hot-dip coating tank. Generally, the hot-dip Al-based alloy coated layer contains Fe at a concentration of not less than 0.05 mass %. Note that Fe is permitted to be contained in the hot-dip Al-based alloy coated layer at a concentration of up to 3.0 mass %, but more preferably not more than 2.5 mass %.

Besides the above elements, an element(s) (such as strontium (Sr), sodium (Na), calcium (Ca), antimony (Sb), phosphorus (P), magnesium (Mg), chromium (Cr), manganese (Mn), Ti, Zr, and/or vanadium (V)) may be intentionally added to the hot-dip Al-based alloy-coating bath as necessary, or the above element(s) coming from, for example, a raw material may be mixed in the hot-dip Al-based alloy-coating bath. The hot-dip Al-coated steel sheet in accordance with an embodiment of the present invention can also contain such an element that has been conventionally commonly permitted. Specifically, for example, hot-dip Al-coated steel sheet can contain Sr at a concentration falling within the range of 0 mass % to 0.2 mass %, Na at a concentration falling within the range of 0 mass % to 0.1 mass %, Ca at a concentration falling within the range of 0 mass % to 0.1 mass %, Sb at a concentration falling within the range of 0 mass % to 0.6 mass %, P at a concentration falling within the range of 0 mass % to 0.2 mass %, Mg at a concentration falling within the range of 0 mass % to 5.0 mass %, Cr at a concentration falling within the range of 0 mass % to 1.0 mass %, Mn at a concentration falling within the range of 0 mass % to 2.0 mass %, Ti at a concentration falling within the range of 0 mass % to 0.5 mass %, Zr at a concentration falling within the range of 0 mass % to 0.5 mass %, and/or V at a concentration falling within the range of 0 mass % to 0.5 mass %.

The remainder, different from the foregoing elements, of the hot-dip Al-based alloy-coating bath can be constituted by Al and unavoidable impurities.

As described earlier, a hot-dip aluminum-based alloy-coated steel sheet in accordance with an embodiment of the present invention includes: a substrate steel sheet; and a hot-dip aluminum-based alloy coated layer which is formed on a surface of the substrate steel sheet and which contains boron at an average concentration of not less than 0.005 mass % and contains potassium at an average concentration of not less than 0.0004 mass %.

In a case where the hot-dip aluminum-based alloy coated layer which contains B at a concentration falling within the above range and contains K at a concentration falling within the above range, not less than 100 spangle crystal nuclei can be present per square centimeter surface area of the hot-dip Al-based alloy coated layer. This makes it possible to produce a hot-dip Al-based alloy-coated steel sheet which includes a coated layer having a surface on which fine spangles are sufficiently formed and which has a beautiful surface appearance due to the fine spangles thus formed on the surface of the coated layer. Such a hot-dip Al-based alloy-coated steel sheet can be obtained by (i) adjusting the respective concentrations of B and K which are contained in the coating bath and (ii) dipping the substrate steel sheet in the coating bath. This makes it possible to achieve the hot-dip Al-based alloy-coated steel sheet in which fine spangles are stably formed.

By referring to FIG. 1 again, the following description will discuss the density of spangle crystal nuclei. As illustrated in FIG. 1, the spangles are non-uniform and irregular in size. However, spangle crystal nuclei are still distinguishable when viewed through, for example, an optical microscope.

Therefore, the number of spangle crystal nuclei per visual field area can be understood by counting the number of spangle crystal nuclei present in that visual field area. From the number of spangle crystal nuclei per visual field area, it is possible to roughly calculate the number of spangle crystal nuclei present per square centimeter surface area of the hot-dip Al-based alloy coated layer. Note that such a counting method as described above is merely an example, and the number of spangle crystal nuclei can be counted by any other method.

The hot-dip Al-based alloy coated layer which contains B at an average concentration of less than 0.005 mass % makes it impossible to achieve a satisfactory effect of finer spangles. Meanwhile, the hot-dip Al-based alloy coated layer which contains B at an average concentration of more than 0.50 mass % causes the effect of finer spangles to reach a maximum, and no superiority is displayed by the hot-dip Al-based alloy coated layer in which the average concentration of B is further increased.

The hot-dip Al-based alloy coated layer which contains B at an average concentration of more than 3.0% may cause a decrease in corrosion resistance. Therefore, from the viewpoint of corrosion resistance of the hot-dip Al-based alloy-coated steel sheet, the hot-dip Al-based alloy coated layer preferably contains B at an average concentration of 0.005 mass % to 3.0 mass %.

The hot-dip Al-based alloy coated layer which contains K at an average concentration of less than 0.0004 mass % makes it impossible to achieve a satisfactory effect of finer spangles. Meanwhile, the hot-dip Al-based alloy coated layer which contains K at an average concentration of more than 0.05 mass % causes the effect of finer spangles to reach the maximum. The hot-dip Al-based alloy coated layer which contains K at an average concentration of not less than 0.03 mass % causes a decrease in corrosion resistance. Therefore, from the viewpoint of corrosion resistance of the hot-dip Al-based alloy-coated steel sheet, the hot-dip Al-based alloy coated layer preferably contains K at an average concentration of 0.0004 mass % to 0.02 mass %.

From the viewpoint of corrosion resistance of the hot-dip Al-based alloy-coated steel sheet, the hot-dip Al-based alloy coated layer is preferably configured to contain B at an average concentration of 0.005 mass % to 3.0 mass % and contain K at an average concentration of 0.0004 mass % to 0.02 mass %. The configuration makes it possible to produce a hot-dip Al-based alloy-coated steel sheet which has a beautiful surface appearance and excellent corrosion resistance.

As described earlier, the effect of finer spangles reaches the maximum in a case where the respective average concentrations of B and K which are contained in the hot-dip Al-based alloy coated layer are increased to some extent. Therefore, according to an embodiment of the present invention, it is unnecessary to set respective upper limits of those concentrations.

The hot-dip Al-based alloy coated layer is preferably configured to contain B at an average concentration of not less than 0.02 mass % and contain K at an average concentration of not less than 0.0008 mass %. The configuration allows not less than 200 spangle crystal nuclei to be present per square centimeter surface area of the hot-dip Al-based alloy coated layer. This makes it possible to produce a hot-dip Al-based alloy-coated steel sheet which has a more beautiful surface appearance.

The hot-dip Al-based alloy coated layer of the hot-dip Al-based alloy-coated steel sheet does not necessarily need to be provided on both sides of the substrate steel sheet, and only needs to be provided on at least one side of the substrate steel sheet.

(Method of Producing Hot-Dip Al-Based Alloy-Coated Steel Sheet)

A hot-dip Al-based alloy-coated steel sheet in accordance with an embodiment of the present invention can be produced by a hot-dip method with use of a coating bath containing B and K at respective adjusted concentrations. For example, the hot-dip Al-based alloy-coated steel sheet can be produced in an experimental line and by a common continuous Al-coating production process (production apparatus). Alternatively, the hot-dip Al-based alloy-coated steel sheet in accordance with an embodiment of the present invention can be produced by applying the present invention to any method, known to a skilled person, of producing a hot-dip Al-coated steel sheet.

A method of producing a hot-dip aluminum-based alloy-coated steel sheet in accordance with an embodiment of the present invention includes a coating step of dipping a substrate steel sheet in a hot-dip aluminum-based alloy-coating bath which contains aluminum as a main component, the hot-dip aluminum-based alloy-coating bath containing boron at a concentration of not less than 0.005 mass % and containing potassium at a concentration of not less than 0.0004 mass %.

The average concentration of each component contained in the hot-dip Al-based alloy coated layer formed through the coating step is substantially identical to the composition of the hot-dip Al-based alloy-coating bath (i.e., the concentration of each component contained in the hot-dip Al-based alloy-coating bath). The configuration makes it possible to produce a hot-dip Al-based alloy-coated steel sheet including a hot-dip Al-based alloy coated layer which contains B at an average concentration of not less than 0.005 mass % and contains K at an average concentration of not less than 0.0004 mass %.

From this, it is preferable that, as with the hot-dip Al-based alloy-coated steel sheet, the hot-dip Al-based alloy-coating bath contain B at a concentration of not less than 0.02 mass % and contain K at a concentration of not less than 0.0008 mass %. Note that the hot-dip Al-based alloy-coating bath preferably contains B at a concentration of 0.005 mass % to 3.0 mass %. Note also that the hot-dip Al-based alloy-coating bath preferably contains K at a concentration of 0.0004 mass % to 0.02 mass %.

At least prior to the coating step, a composition adjusting step of adjusting a composition of the hot-dip Al-based alloy-coating bath is carried out by adjusting respective concentrations of elements contained in the hot-dip Al-based alloy-coating bath. In the composition adjusting step, the composition of the hot-dip Al-based alloy-coating bath can be adjusted as below.

The concentration of B contained in the hot-dip Al-based alloy-coating bath is preferably configured to be adjusted by adding an aluminum master alloy containing B. The configuration allows suitable dispersion of B in the hot-dip Al-based alloy-coating bath. The concentration of B contained in the hot-dip Al-based alloy-coating bath can alternatively be adjusted by adding B alone or a boride such as aluminum boride ($AlB_2$ or $AlB_{12}$), and a method of adjusting the concentration is not limited to any particular method. The hot-dip Al-based alloy-coating bath which contains such a raw material needs to be subjected to a process for uniformly dispersing B in the hot-dip Al-based alloy-coating bath.

Similarly, the concentration of K contained in the hot-dip Al-based alloy-coating bath is preferably configured to be adjusted by adding an aluminum master alloy containing K. The configuration allows suitable dispersion of K in the hot-dip Al-based alloy-coating bath. The concentration of K contained in the hot-dip Al-based alloy-coating bath can alternatively be adjusted by adding K alone or a compound such as KF, $KBF_4$, or $K_2AlF_6AlB_2$, and a method of adjusting the concentration is not limited to any particular method. The hot-dip Al-based alloy-coating bath which contains such a raw material needs to be subjected to a process for uniformly dispersing K in the hot-dip Al-based alloy-coating bath.

The respective concentrations of B and K which are contained in the hot-dip Al-based alloy-coating bath are preferably configured to be adjusted by adding an aluminum master alloy containing B and K. With the configuration, the addition of such an aluminum master alloy allows B and K to be easily and suitably dispersed in the hot-dip Al-based alloy-coating bath. In this case, the respective concentrations of B and K which are contained in the aluminum master alloy have a ratio that is substantially equal to a ratio between the respective concentrations of B and K which are contained in the hot-dip Al-based alloy-coating bath. Alternatively, the respective concentrations of B and K which are contained in the hot-dip Al-based alloy-coating bath can be configured to be adjusted as desired by adding a plurality of aluminum master alloys which differ from each other in amount of B contained and in amount of K contained. The configuration can be summarized as below. The method of producing the hot-dip aluminum-based alloy-coated steel sheet preferably further includes a composition adjusting step of adjusting a composition of the hot-dip aluminum-based alloy-coating bath, the composition adjusting step including adding an aluminum master alloy containing boron and potassium.

In a case where the hot-dip Al-based alloy-coating bath contains Si, the concentration of Si is preferably adjusted by adding an aluminum master alloy containing Si. Furthermore, it is only necessary that other element(s) that can be contained in the hot-dip Al-based alloy-coating bath be added by a well-known method so that a concentration(s) of the element(s) is/are adjusted.

Note here that an industrial continuous Al-coating producing apparatus is configured such that substrate steel sheets are continuously dipped in a hot-dip Al-based alloy-coating bath so that hot-dip Al-based alloy-coated steel sheets are continuously produced. During the production, each component contained in the hot-dip Al-based alloy-coating bath is gradually reduced by an amount in which the substrate steel sheets are coated with the each component. This makes it necessary to compensate for the reduction in hot-dip Al-based alloy-coating bath by any method.

As described earlier, the respective concentrations of B and K which are contained in the hot-dip Al-based alloy-coating bath can be adjusted by adding an aluminum master alloy containing B and K. This makes it possible to easily compensate for the reduction in hot-dip Al-based alloy-coating bath by using an aluminum master alloy containing B and K in desired amounts, or using a plurality of aluminum master alloys which differ from each other in amount B contained and in amount of K contained. In a case where the hot-dip Al-based alloy-coating bath contains Si, it is only necessary to simultaneously add an aluminum master alloy containing Si. By thus carrying out the composition adjusting step concurrently with the coating step, it is possible to continuously and stably produce hot-dip Al-based alloy-coated steel sheets each having a beautiful surface appearance.

As described earlier, a hot-dip aluminum-based alloy-coated steel sheet in accordance with an embodiment of the present invention includes: a substrate steel sheet; and a hot-dip aluminum-based alloy coated layer which is formed on a surface of the substrate steel sheet and which contains boron at an average concentration of not less than 0.005 mass % and contains potassium at an average concentration of not less than 0.0004 mass %.

The hot-dip aluminum-based alloy-coated steel sheet in accordance with an embodiment of the present invention is configured such that not less than 100 spangle crystal nuclei are present on a surface of the hot-dip aluminum-based alloy coated layer per square centimeter surface area of the hot-dip aluminum-based alloy coated layer.

The hot-dip aluminum-based alloy-coated steel sheet in accordance with an embodiment of the present invention is preferably configured such that the hot-dip aluminum-based alloy coated layer contains boron at an average concentration of not less than 0.02 mass % and contains potassium at an average concentration of not less than 0.0008 mass %.

A method of producing a hot-dip aluminum-based alloy-coated steel sheet in accordance with an embodiment of the present invention includes a coating step of dipping a substrate steel sheet in a hot-dip aluminum-based alloy-coating bath which contains aluminum as a main component, the hot-dip aluminum-based alloy-coating bath containing boron at a concentration of not less than 0.005 mass % and containing potassium at a concentration of not less than 0.0004 mass %.

The method of producing the hot-dip aluminum-based alloy-coated steel sheet in accordance with an embodiment of the present invention is preferably configured such that the hot-dip aluminum-based alloy-coating bath contains boron at a concentration of not less than 0.02 mass % and contains potassium at a concentration of not less than 0.0008 mass %.

The method of producing the hot-dip aluminum-based alloy-coated steel sheet in accordance with an embodiment of the present invention preferably further includes a composition adjusting step of adjusting a composition of the hot-dip aluminum-based alloy-coating bath, the composition adjusting step including adding an aluminum master alloy containing boron and potassium.

The present invention is not limited to the embodiments, but can be altered by a skilled person in the art within the scope of the claims. The present invention also encompasses, in its technical scope, any embodiment derived by combining technical means disclosed in differing embodiments.

EXAMPLES

A hot-dip Al-based alloy-coated steel sheet (test sample) was produced as below in an experimental line with use of coating experimental equipment by using, as a substrate steel sheet, a cold-rolled annealed steel sheet having a thickness of 0.8 mm and having the chemical composition shown in Table 1. Specifically, the hot-dip Al-based alloy-coated steel sheet was produced by (i) dipping the substrate steel sheet in a hot-dip Al-based alloy-coating bath prepared as described later, (ii) taking out the substrate steel sheet thus dipped, and (iii) solidifying a coated layer at a given cooling rate.

As the hot-dip Al-based alloy-coating bath, hot-dip Al-based alloy-coating baths having various compositions were prepared as below.

The concentration of Si contained in the coating bath was adjusted to 0 mass % to 14.0 mass % with use of an Al-20 mass % Si master alloy (an Al master alloy containing Si at a concentration of 20 mass %). Then, the concentration of B contained in the coating bath was adjusted to 0 mass % to 3.0 mass % by adding, to the coating bath, a given amount of an Al-4 mass % B master alloy (an Al master alloy containing B at a concentration of 4 mass %). Furthermore, the concentration of K contained in the coating bath was adjusted to 0.0001 mass % to 0.05 mass % by adding a given amount of KF to the coating bath. Assuming that Fe coming from the substrate steel sheet and/or a constituent member(s) of a pot during continuous production was unavoidably mixed in the coating bath, the concentration of Fe contained in the coating bath was adjusted to 2.0 mass % by melting, in the coating bath, the cold-rolled annealed steel sheet serving as the substrate steel sheet. The remainder of the coating bath was constituted by Al and unavoidable impurities.

The substrate steel sheet was dipped in the coating bath, set at a temperature of 650° C. to 680° C., for two seconds, was taken out of the coating bath, and then was cooled at a cooling rate of 13° C./sec. Respective amounts (concentrations) of Si, B, and K which were contained in the coated layer of each Example are shown in Table 2. Coating had, per surface thereof, a thickness of approximately 20 μm.

TABLE 1

| Chemical composition (mass %) | | | | | | | |
|---|---|---|---|---|---|---|---|
| C | Si | Mn | P | S | Al | O | N |
| 0.033 | <0.01 | 0.23 | <0.01 | 0.013 | 0.01 | 0.0027 | 0.0025 |

A resultant coated steel sheet was subjected to the following examinations.

(Analysis of Components of Coated Layer by ICP)

First, the coated layer was melted by the following procedure so that each component of the coated layer was quantified.

Test samples produced with use of the foregoing hot-dip Al-based alloy-coating baths having various compositions were each cut into a piece having a given size, so that a test sample piece was prepared. The test sample piece was put into an NaOH solution (10 ml) at a concentration of 25%, was left to stand still, and then was heated so that the coated layer was completely melted in the solution. After it was confirmed that the coated layer had been completely melted, the test sample piece, from which the coated layer had been removed by being melted, was taken out of the solution. Subsequently, the solution was further heated so that the liquid was evaporated to dryness. A product obtained as a result of evaporation to dryness was dissolved in a mixed acid (a mixed solution of 40 ml of nitric acid and 10 ml of hydrochloric acid) while being heated, and ultrapure water was added to a resultant solution so that the volume of the solution was adjusted to a constant volume of 250 ml. The solution which had been obtained from the test sample piece and whose volume had been thus made constant was used as a solution for use in measurement of the composition of each test sample.

Thereafter, the solution for use in measurement of the composition of each test sample was subjected to the following two types of quantitative analyses so that the composition of the coated layer was found.

The quantitative analysis of Si, B, and Fe was carried out by an inductively coupled plasma atomic emission spectrometry method (ICP-AES method). The quantitative analysis of K was carried out by an inductively coupled plasma mass spectrometry method (ICP-MS method).

(Number of Spangle Crystal Nuclei on Surface of Coated Layer)

A dendrite structure was made observable by buffing the surface of each test sample so as to make smoother the outermost surface layer extending from the surface of the coated layer to the depth of 5 μm. Then, the number of spangle crystal nuclei present per square centimeter surface area of the coated layer was calculated with use of an optical microscope. The coated layer was evaluated based on the following criteria, and the coated layer evaluated as "Good" or "Excellent" was regarded as acceptable.

Excellent: Not less than 200 spangle crystal nuclei were present per square centimeter surface area of the coated layer.

Good: Not less than 100 and less than 200 spangle crystal nuclei were present per square centimeter surface area of the coated layer.

Poor: Not less than 50 and less than 100 spangle crystal nuclei were present per square centimeter surface area of the coated layer.

Very Poor: Less than 50 spangle crystal nuclei were present per square centimeter surface area of the coated layer.

(Corrosion Resistance of Coated Layer)

An untreated hot-dip Al-based alloy coated layer of each test sample was subjected to a neutral salt spray test (NSS test), specified by JIS Z2371:2000, so that a ratio of an area of white rust formation to the entire coated layer was measured. Corrosion resistance of the coated layer was evaluated based on the following criteria, and the coated layer evaluated as "Good" was regarded as acceptable.

Good: The ratio of the area of white rust formation to the entire coated layer was not less than 0% and less than 5%.

Fair: The ratio of the area of white rust formation to the entire coated layer was not less than 5% and less than 20%.

Poor: The ratio of the area of white rust formation to the entire coated layer was not less than 20%.

Results of the above examinations are shown in Table 2.

TABLE 2

| Class | No. | Amount (Concentration) of Component Contained in Coating Layer (mass %) Si | B | K | Density of Spangles (per $cm^2$) | Grade of Surface Appearance | Corrosion Resistance |
|---|---|---|---|---|---|---|---|
| Examples of present invention | 1 | 0 | 0.01 | 0.0004 | 120 | Good | Good |
| | 2 | 0.5 | 0.02 | 0.0005 | 150 | Good | Good |
| | 3 | 1 | 0.02 | 0.0005 | 150 | Good | Good |
| | 4 | 2 | 0.025 | 0.0008 | 400 | Excellent | Good |
| | 5 | 3 | 0.02 | 0.0008 | 200 | Excellent | Good |
| | 6 | 5 | 0.02 | 0.0008 | 200 | Good | Good |
| | 7 | 8.8 | 0.018 | 0.0005 | 180 | Good | Good |
| | 8 | 8.9 | 0.01 | 0.0004 | 120 | Good | Good |
| | 9 | 9 | 0.02 | 0.0004 | 150 | Good | Good |
| | 10 | 9.1 | 0.02 | 0.0008 | 200 | Excellent | Good |
| | 11 | 9.2 | 0.02 | 0.0015 | 200 | Excellent | Good |
| | 12 | 9.2 | 0.05 | 0.002 | 500 | Excellent | Good |
| | 13 | 9.5 | 0.5 | 0.02 | 500 | Excellent | Good |
| | 14 | 10 | 1 | 0.02 | 200 | Excellent | Good |
| | 15 | 12.3 | 2 | 0.02 | 200 | Excellent | Good |
| | 16 | 13.1 | 0.03 | 0.02 | 400 | Excellent | Good |
| | 17 | 5 | 3 | 0.02 | 500 | Excellent | Good |
| | 18 | 9 | 0.022 | 0.03 | 300 | Excellent | Poor |
| | 19 | 9.2 | 0.05 | 0.05 | 500 | Excellent | Poor |
| Comparative Examples | 20 | 2 | 0.002 | 0.0004 | 20 | Very Poor | Good |
| | 21 | 8.8 | 0.02 | 0.0001 | 60 | Poor | Good |
| | 22 | 9 | 0.02 | 0.0003 | 80 | Poor | Good |
| | 23 | 9.2 | o | 0.0001 | 5 | Very Poor | Good |
| | 24 | 12 | 0 | 0.0004 | 5 | Very Poor | Good |
| | 25 | 9.2 | 0.002 | 0.0001 | 8 | Very Poor | Good |
| | 26 | 9.5 | 0.015 | 0.0001 | 70 | Poor | Good |
| | 27 | 9 | 0.022 | 0.0001 | 60 | Poor | Good |
| | 28 | 8.9 | 0.03 | 0.0001 | 70 | Poor | Good |
| | 29 | 9.1 | 0.05 | 0.0001 | 80 | Poor | Good |

As shown in Nos. 1 to 19 of Table 2, according to Examples in each of which the coated layer contained B and K at respective average concentrations falling within the ranges defined by an embodiment of the present invention, not less than 100 spangle crystal nuclei were present per square centimeter surface area of the coated layer. This brought about a good effect of finer spangles. Examples of the present invention reveal that an embodiment of the present invention makes it possible to obtain a hot-dip Al-based alloy-coated steel sheet which includes a coated layer having a surface on which fine spangles are stably and sufficiently formed and which has a beautiful surface appearance due to the fine spangles thus formed on the surface of the coated layer.

Examples of Nos. 4, 5, and 10 to 19 reveal (i) that not less than 200 spangle crystal nuclei were present per square centimeter surface area of the coated layer which contained B at an average concentration of not less than 0.02 mass % and contained K at an average concentration of 0.0008 mass % and (ii) that such a coated layer makes it possible to obtain a hot-dip Al-based alloy-coated steel sheet which has a more beautiful surface appearance.

Examples of Nos. 1 to 17 reveal that the coated layer which contained K at an average concentration of 0.0004 mass % to 0.02 mass % had good corrosion resistance and makes it possible to obtain a hot-dip Al-based alloy-coated steel sheet which has a beautiful surface appearance and has excellent corrosion resistance.

In contrast, according to Comparative Examples Nos. 20 to 29 in each of which the coated layer contained B and K at respective average concentrations outside (less than lower limits of) the ranges defined by an embodiment of the present invention, less than 100 spangle crystal nuclei were present per square centimeter surface area of the coated layer. This (i) revealed that the effect of finer spangles was not good enough and (ii) resulted in obtainment of the hot-dip Al-based alloy-coated steel sheets each having a poor surface appearance.

Note that, as shown in Nos. 1 to 29 of Table 2, the average concentration of Si contained in the coated layer did not particularly affect the effect of the present invention.

The invention claimed is:

1. A hot-dip aluminum-based alloy-coated steel sheet, comprising:

a substrate steel sheet; and a hot-dip aluminum-based alloy coated layer which is formed on a surface of the substrate steel sheet and which contains boron at an average concentration of not less than 0.005 mass % and not more than 3.0 mass % and contains potassium at an average concentration of not less than 0.0004 mass % and not more than 0.02 mass %, wherein not less than 100 spangle crystal nuclei are present on a surface of the hot-dip aluminum-based alloy coated layer per square centimeter surface area of the hot-dip aluminum-based alloy coated layer.

2. The hot-dip aluminum-based alloy-coated steel sheet as set forth in claim 1, wherein the hot-dip aluminum-based alloy coated layer contains boron at an average concentration of not less than 0.02 mass % and not more than 3.0 mass % and contains potassium at an average concentration of not less than 0.0008 mass % and not more than 0.02 mass %.

3. A method of producing a hot-dip aluminum-based alloy-coated steel sheet according to claim 1, comprising:

a coating step of dipping a substrate steel sheet in a hot-dip aluminum-based alloy-coating bath which contains aluminum as a main component, the hot-dip aluminum-based alloy-coating bath containing boron at a concentration of not less than 0.005 mass % and not more than 3.0 mass % and containing potassium at a concentration of not less than 0.0004 mass % and not more than 0.02 mass %.

4. The method as set forth in claim 3, wherein the hot-dip aluminum-based alloy-coating bath contains boron at a concentration of not less than 0.02 mass % and not more than 3.0 mass % and contains potassium at a concentration of not less than 0.0008 mass % and not more than 0.02 mass %.

5. The method as set forth in claim 4, further comprising:

a composition adjusting step of adjusting a composition of the hot-dip aluminum-based alloy-coating bath, the composition adjusting step including adding an aluminum master alloy containing boron and potassium.

6. The method as set forth in claim 3, further comprising:

a composition adjusting step of adjusting a composition of the hot-dip aluminum-based alloy-coating bath, the composition adjusting step including adding an aluminum master alloy containing boron and potassium.

* * * * *